US009468063B2

(12) United States Patent
Hatta

(10) Patent No.: US 9,468,063 B2
(45) Date of Patent: Oct. 11, 2016

(54) LIGHT SOURCE DRIVING DEVICE AND METHOD FOR DRIVING LIGHT SOURCE

(71) Applicant: MINEBEA CO., LTD., Kitasaku-Gun, Nagano (JP)

(72) Inventor: Kunihiko Hatta, Yokohama (JP)

(73) Assignee: Minebea Co., Ltd., Nagano (JP)

( * ) Notice: Subject to any disclaimer, the term of this patent is extended or adjusted under 35 U.S.C. 154(b) by 0 days.

(21) Appl. No.: 14/637,540

(22) Filed: Mar. 4, 2015

(65) Prior Publication Data

US 2015/0264759 A1 Sep. 17, 2015

(30) Foreign Application Priority Data

Mar. 11, 2014 (JP) ..... 2014-048035

(51) Int. Cl.
*H05B 37/02* (2006.01)
*H05B 33/08* (2006.01)

(52) U.S. Cl.
CPC ..... *H05B 33/0845* (2013.01); *H05B 37/0254* (2013.01)

(58) Field of Classification Search
CPC ..... H05B 33/08; H05B 33/0815; H05B 33/0842; H05B 33/0845; H05B 37/02
USPC ..... 315/209 R, 291, 307, 308, 312
See application file for complete search history.

(56) References Cited

U.S. PATENT DOCUMENTS 8,212,485 B2 * 7/2012 Elek ..... H05B 37/0272 315/130
9,119,240 B2 * 8/2015 Nagazoe ..... H04B 10/116

FOREIGN PATENT DOCUMENTS

JP 2012-507116 A 3/2012
WO 2010/062449 A2 6/2010

* cited by examiner

*Primary Examiner* — Jimmy Vu
(74) *Attorney, Agent, or Firm* — Carrier Blackman & Associates, P.C.; William D. Blackman; Jeffrey T. Gedeon

(57) ABSTRACT

There is provided a light source driving device including: an interface circuit configured to receive a PWM dimming instruction signal or a DALI dimming instruction signal as a dimming instruction signal and generate a serial signal in accordance with the dimming instruction signal; a dimming controller configured to determine whether the serial signal generated by the interface circuit is based on the PWM dimming instruction signal or the DALI dimming instruction signal and to generate a dimming signal according to a result of the determination; and a drive circuit configured to drive a light source according to the dimming signal generated by the dimming controller.

6 Claims, 5 Drawing Sheets

1
2
INTERFACE CIRCUIT
D+
D-
Sad
Rx
4
INFORMATION DETERMINATION UNIT
Sd
Tx
6
DALI FRAME CONTROL UNIT
Sdp
7
SIGNAL GENERATION UNIT
DALI DIMMING SIGNAL GENERATION UNIT
5
Sp
8
PWM DIMMING SIGNAL GEN-ERATION UNIT
3
DIMMING CONTROLLER
Sc
9
DRIVE CIRCUIT
10
LIGHT SOURCE

LIGHT SOURCE DRIVING DEVICE AND METHOD FOR DRIVING LIGHT SOURCE

BACKGROUND OF THE INVENTION

1. Field of the Invention

The present invention relates to a light source driving device and a method for driving a light source.

2. Description of the Related Art

Among known dimming methods are one in which a PWM signal as a dimming instruction signal is input to a light source driving device and a light source is dimming-controlled according to its duty ratio and one in which a control signal of 0 to 10 V as a dimming instruction signal is input to a light source driving device and a light source is dimming-controlled according to its analog value.

On the other hand, in recent years, digital addressable lighting interface system (DALI system) in which DALI signals as dimming instruction signals is sent to respective light source driving devices to control them have been developed as lighting control systems mainly in Europe.

However, such light source driving devices may have problems in that the number of components increases and the devices themselves become larger in order to accommodate the above-mentioned dimming methods they may need to be equipped with dimming controllers for the respective methods and a switching means for selecting between the dimming methods.

To solve the above problems, a dimming interface circuit has been proposed which can accommodate both of a control signal of 0 to 10 V and a DALI signal by means of a single dimming controller (see, for example WO2010/062449A2).

However, in the technique disclosed in WO2010/062449A2, since the dimming controller automatically determines a control signal of 0 to 10 V a determination result "0 V" is produced if no connection is made, possibly causing an erroneous operation.

SUMMARY OF THE INVENTION

The present invention has been made in view of the above circumstances, and one of objects of the present invention is therefore to provide a light source driving device and a method for driving a light source which is compatible with both of a PWM signal and a DALI signal by means of a single dimming controller.

According to an illustrative embodiment of the present invention, there is provided a light source driving device including: an interface circuit configured to receive a PWM dimming instruction signal or a DALI dimming instruction signal as a dimming instruction signal and generate a serial signal in accordance with the dimming instruction signal; a dimming controller configured to determine whether the serial signal generated by the interface circuit is based on the PWM dimming instruction signal or the DALI dimming instruction signal and to generate a dimming signal according to a result of the determination; and a drive circuit configured to drive a light source according to the dimming signal generated by the dimming controller.

According to another illustrative embodiment of the present invention, there is provided a method for driving a light source according to a dimming instruction signal, the method including: receiving a PWM dimming instruction signal or a DALI dimming instruction signal as the dimming instruction signal; generating a serial signal in accordance with the dimming instruction signal; determining whether the serial signal is based on the PWM dimming instruction signal or the DALI dimming instruction signal; generating a dimming signal according to a result of the determination; and driving a light source according to the dimming signal.

DETAILED DESCRIPTION

Figure 1:
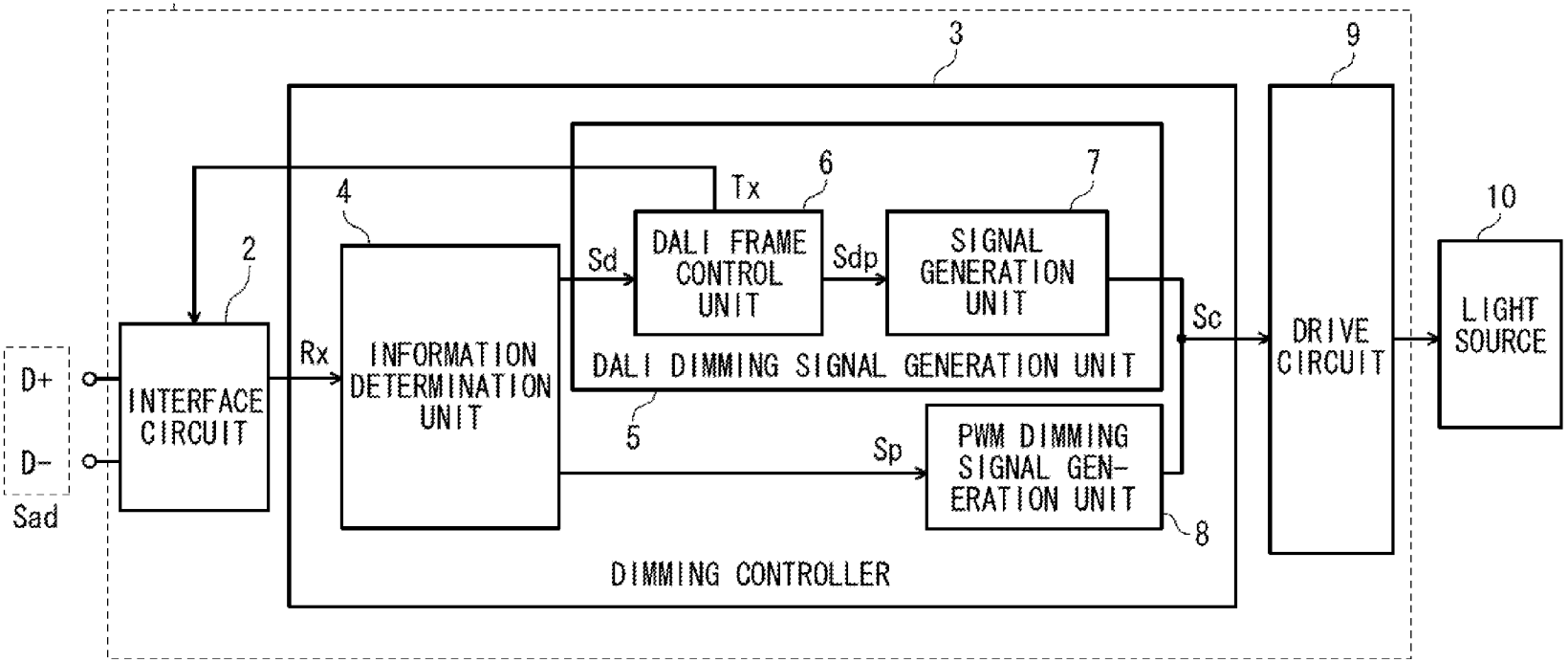
FIG. 1 is a block diagram showing a general configuration of a light source driving device according to an embodiment of the present invention.

Hereinafter, an embodiment of the invention will be described with reference to the drawings. The same elements will be given the same reference numeral throughout the embodiment.

First, a general configuration of a light source driving device 1 according to the embodiment will be described. FIG. 1 is a block diagram showing a general configuration of the light source driving device 1 according to the embodiment.

As shown in FIG. 1, the light source driving device 1 is equipped with a single interface circuit 2, a dimming controller 3, and a drive circuit 9. The light source driving device 1 serves to drive a light source 10 according to a received dimming instruction signal Sad. The light source driving device 1 receives, as a dimming instruction signal Sad, a PWM dimming instruction signal Sadp or a DALI dimming instruction signal Sadd, and can accommodate both of a pulse-width modulation signal (PWM signal) and a digital addressable lighting interface signal (DALI signal).

The interface circuit 2 generates a serial signal Rx corresponding to a received PWM dimming instruction signal Sadp or DALI dimming instruction signal Sadd. The dimming controller 3 controls a current according to the type and the level, corresponding to the brightness of the light source 10, of the dimming instruction signal (i.e., received serial signal Rx). The dimming controller 3 determines whether the received serial signal Rx is one based on a PWM dimming instruction signal Sadp or one based on a DALI dimming instruction signal Sadd, and generates a dimming signal Sc that is based on the level of the serial signal Rx. The drive circuit 9 receives the dimming signal Sc and drives the light source 10 according to its level.

The interface circuit 2 will be described below in detail. As for the specification of the DALI dimming instruction signal Sadd which serves for transmission of a potential difference between two lines D+ and D− (i.e., a differential signal), the H-level-side voltage has a voltage variation width of 9.5 to 22.5 V and the L-level-side voltage has a voltage variation width of −6.5 to 6.5 V. As for the specification of the PWM dimming instruction signal Sadp which also serves for transmission of a potential difference between two lines D+ and D− (i.e., a differential signal), its voltage difference has a voltage variation width of 16 V, for example.

In the dimming controller 3 which is, for example, a microcontroller, the voltage specification of an input unit of the microcontroller is 5 V, for example. The dimming controller 3 may be required to be electrically insulated from, for example, a dimming control device that outputs a dimming instruction signal Sad. The interface circuit 2 which is, for example, an analog circuit, has a function of converting a dimming instruction signal Sad which has a wide voltage variation width into a signal that is compatible with the input voltage specification (5 V or lower) of the microcontroller, a function of converting a dimming instruction signal Sad which is a differential signal into a serial signal Rx which does not have polarity, and a function of establishing electrical insulation. Therefore, the interface circuit 2 is configured using a photocoupler, for example.

Next, the dimming controller 3 will be described. The dimming controller 3 is equipped with an information determination unit 4, a DALI dimming signal generation unit 5, a DALI frame control unit 6, a signal generation unit 7, and a PWM dimming signal generation unit 8. The information determination unit 4 determines whether a received serial signal Rx is one based on a PWM dimming instruction signal Sadp or one based on a DALI dimming instruction signal Sadd, and generates DALI command information Sd or PWM dimming information Sp according to a result of the determination. When receiving DALI command information Sd from the information determination unit 4, the DALI dimming signal generation unit 5 generates a dimming signal Sc on the basis of the received DALI command information Sd.

The DALI frame control unit 6 receives the DALI command information Sd and generates DALI dimming information Sdp on the basis of the received DALI command information Sd. The DALI command information Sd contains DALI dimming information Sdp, command information, channel information (e.g., an identification number or a group number of the light source driving device 1 in a system in which many light source driving devices are connected), and other information. After analyzing the information contained in the DALI command information Sd the DALI frame control unit 6 generates DALI dimming information Sdp output which is dimming information. Furthermore, the DALI frame control unit 6 outputs, to, for example, a dimming control device, a transmission serial signal Tx (see FIG. 2) which is response information to the DALI command information Sd. The signal generation unit 7 receives the DALI dimming information Sdp and generates a dimming signal Sc on the basis of the received DALI dimming information Sdp.

When receiving PWM dimming information Sp from the information determination unit 4, the PWM dimming signal generation unit 8 generates a dimming signal Sc on the basis of the received PWM dimming information Sp.

The drive circuit 9 is a power source device having a known configuration that can output DC power or AC power that is suitable for the light source 10. That is, the drive circuit 9 is a discharge lamp lighting device if the light source 10 is a discharge lamp, and is an LED driving device if the light source 10 is an LED(s).

Figure 2:
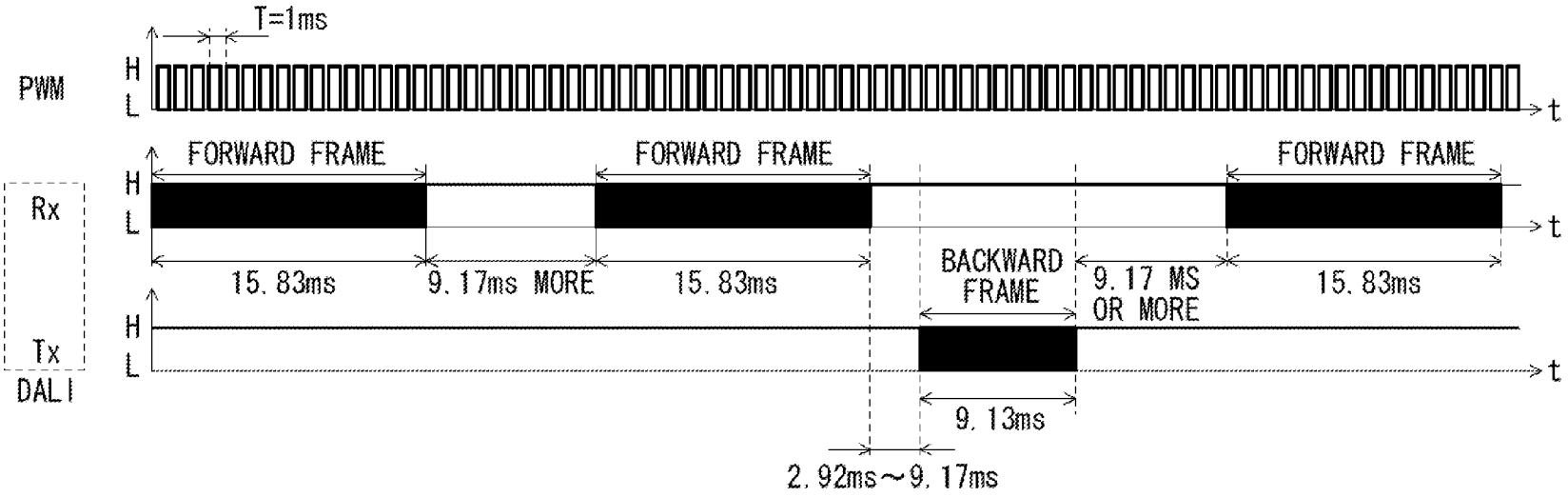
FIG. 2 shows a waveform of a serial signal Rx that is generated on the basis of a PWM dimming instruction signal Sadp, a waveform of a serial signal Rx that is generated on the basis of a DALI dimming instruction signal Sadd, and a waveform of a serial signal Tx.

Next, the serial signal Rx will be described. FIG. 2 shows a waveform of a serial signal Rx that is generated on the basis of a PWM dimming instruction signal Sadp. The cycle of the PWM dimming instruction signal Sadp is set at 1 ms (Which corresponds to 1 kHz). FIG. 2 also shows a waveform of serial signal Rx that is generated on the basis of a DALI dimming instruction signal Sadd, and a waveform of serial signal Tx.

According to the DALI communication standard, a communication is performed by exchanging pulse signals called forward frames (i.e., DALI frames described later) and backward frames that are coded by Manchester encoding which is a coding method in which bit values "1" and "0" are defined using voltage variation edges rather than voltage levels such as "H" and "L." The forward frame is a signal that is transmitted to the dimming controller 3 from a dimming control device that outputs a DALI dimming instruction signal Sadd, and the backward frame is a signal that is transmitted in the opposite direction. A pulse signal in the interval of each forward frame or each backward frame includes a higher frequency than the PWM signal shown in FIG. 2, and hence is drawn in black in serial signal Rx and serial signal Tx for the sake of convenience.

The transmission timing of forward frames and backward frames is characterized by a rule that a halt interval having a prescribed time length should be set between them. That is, in the serial signal Rx 2, a halt interval of 9.17 ms or longer exists between forward frames. Therefore, by detecting such a halt interval, it can be determined whether a serial signal Rx is a signal based on a PWM dimming instruction signal Sadp or a signal based on a DALI dimming instruction signal Sadd. It is noted that the waveforms shown in FIG. 2 are of negative logic (low active); the signal level is high when no frame exists.

Figure 3:
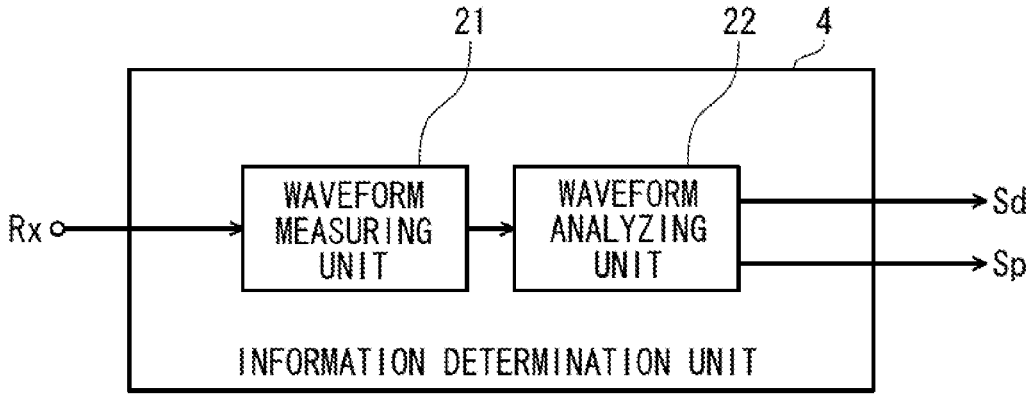
FIG. 3 is a block diagram showing the configuration of an information determination unit used in the embodiment.

Next, a method for judging a serial signal Rx will be described. FIG. 3 is a block diagram showing the configuration of the information determination unit 4 used in the embodiment. As shown in FIG. 3, the information determination unit 4 is equipped with a waveform measuring unit 21 and a waveform analyzing unit 22.

The waveform measuring unit 21, which is, for example, a timer circuit, measures the cycle of a received serial signal Rx and outputs resulting measurement information. The waveform analyzing unit 22 determines, using the measurement information that is output from the waveform measuring unit 21, whether or not the serial signal Rx contains a DALI frame. Whether the received serial signal Rx is a signal based on a PWM dimming instruction signal Sadp or a DALI dimming instruction signal Sadd can be determined by the waveform measuring unit 21 and the waveform analyzing unit 22.

Figure 4:
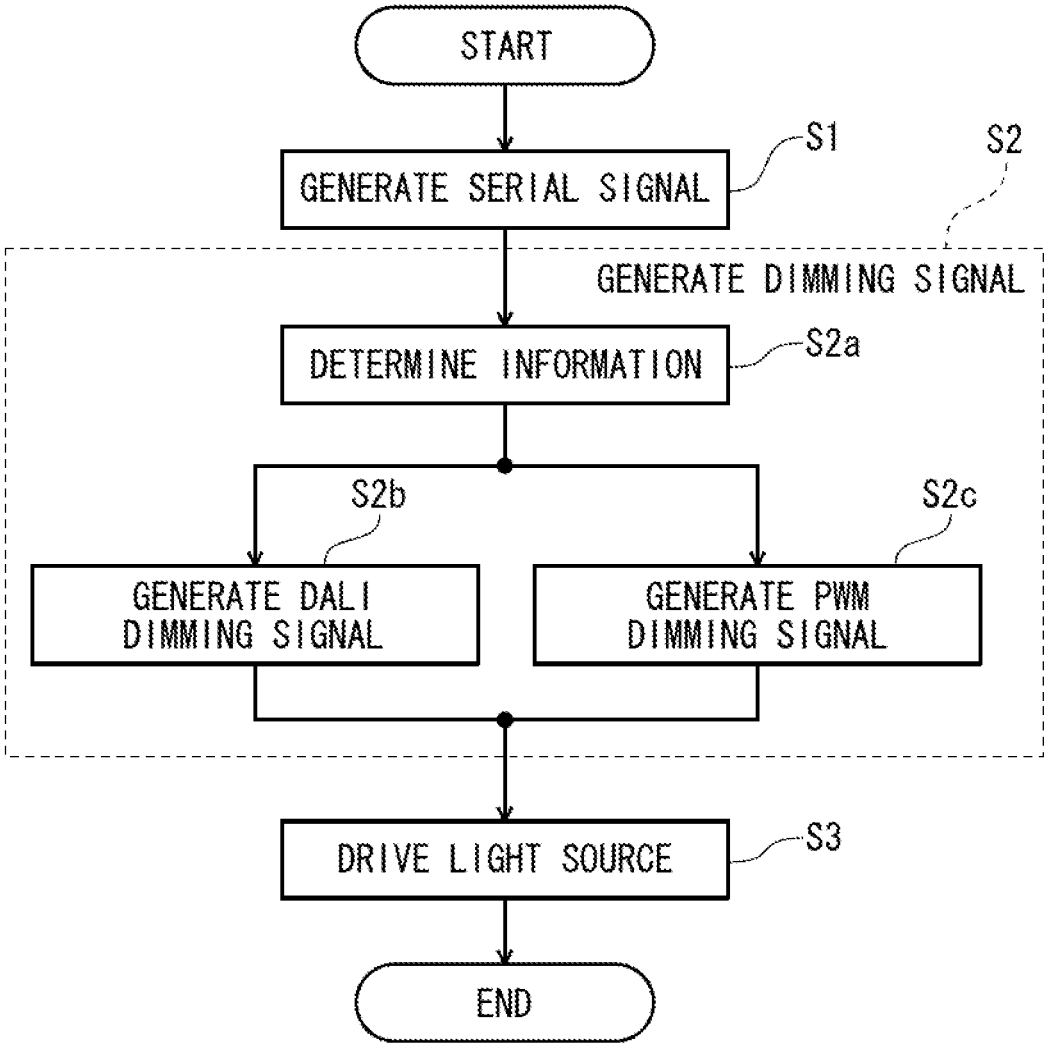
FIG. 4 is a flowchart showing a light source drive method according to the embodiment.

Next, a light source drive method according to the embodiment of the invention will be described with reference to a flowchart of FIG. 4. At step S1 (serial signal generating step), a serial signal Rx is generated according to a PWM dimming instruction signal Sadp or a DALI dimming instruction signal Sadd that is input as a dimming instruction signal. At step S2 (dimming signal generating step), it is determined whether the serial signal Rx is a signal based on a PWM dimming instruction signal Sadp or a DALI dimming instruction signal Sadd and a dimming signal Sc is generated according to a result of the determination.

Step S2 may be broken down into steps S2*a*-S2*c*. At step S2*a* (information determining step). DALI command information Sd or PWM dimming information Sp is generated on the basis of the serial signal Rx. If it is determined that the serial signal Rx is a signal based on a DALI dimming instruction signal Sadd, at step S2*b* (DALI dimming signal generating step) a dimming signal Sc is generated on the basis of the generated DALI command information Sd. If it is determined that the serial signal Rx is a signal based on a PWM dimming instruction signal Sadp, at step S2*c* (PWM dimming signal generating step) a dimming signal Sc is generated on the basis of the generated PWM dimming information Sp. At step S3 (driving step), the light source 10 is driven according to the dimming signal Sc.

Figure 5:
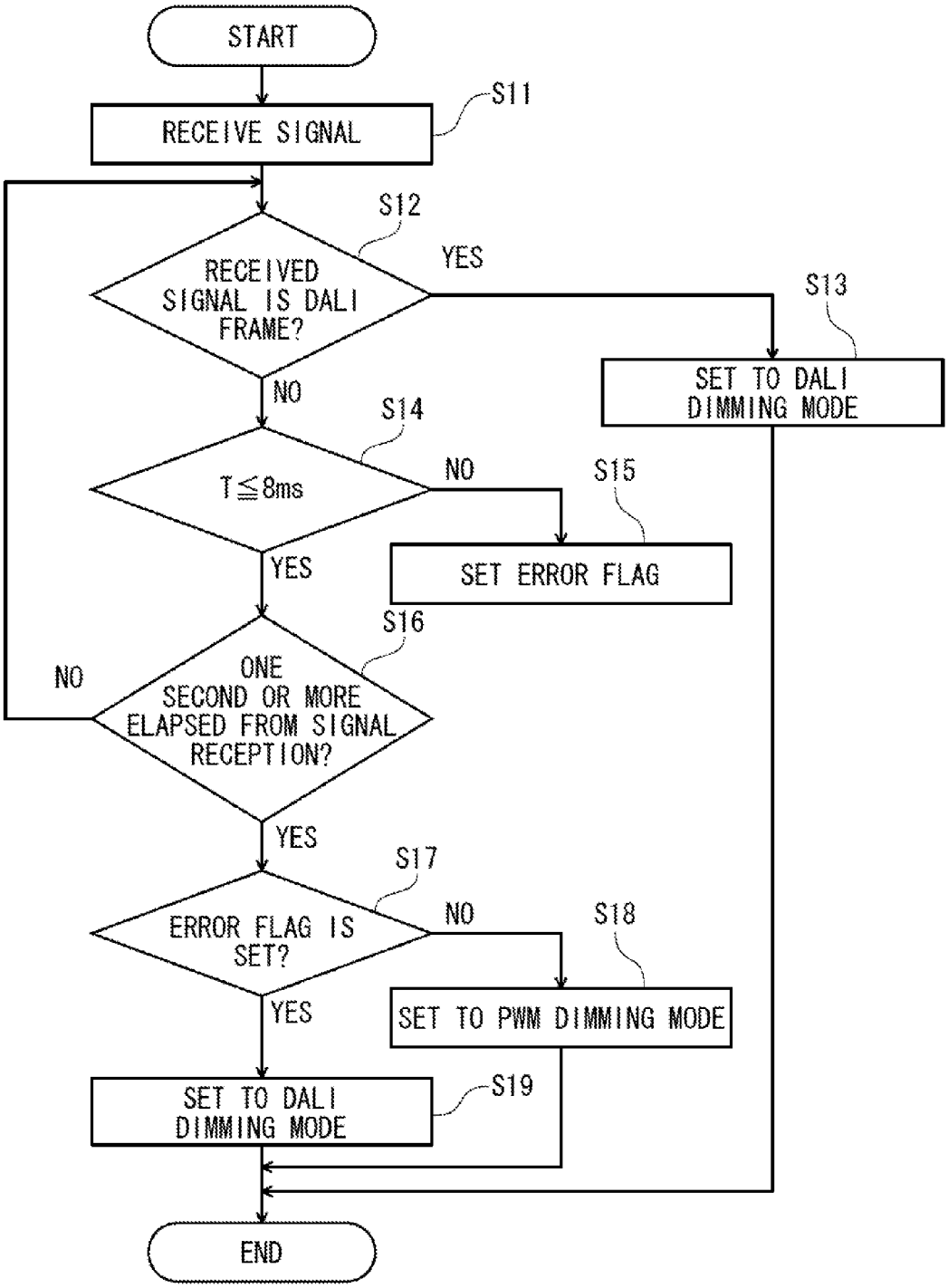
FIG. 5 is a flowchart showing a process that is executed by the information determination unit.

FIG. 5 is a flowchart showing a process that is executed by the information determination unit 4. The following description will be made with an assumption that the prescribed cycle of the serial signal Rx is 8 ms and the prescribed time from a reception start time is 1 s. At step S11, the waveform measuring unit 21 receives a serial signal Rx, starts measurement of its cycle and stores a reception start time. And the information determination unit 4 initializes an error flag memory.

At step S12 (DALI frame determining step), the waveform analyzing unit 22 determines whether or not the received serial signal Rx contains a DALI frame that satisfies the DALI communication standard. If the received serial signal Rx is determined to contain a DALI frame, the waveform analyzing unit 22 moves to step S13, where it sets a DALI dimming mode and outputs DALI command information Sd to the DALI frame control unit 6. If the received serial signal Rx is determined to contain no DALI frame, the waveform analyzing unit 22 moves to step S14.

At step S14 (cycle determining step), the waveform analyzing unit 22 determines whether or not the serial signal Rx has a halt interval (9.17 ms). That is, the waveform analyzing unit 22 determines the presence/absence of a halt interval by judging whether the cycle of the serial signal Rx is shorter than or equal to 8 ms on the basis of cycle measurement information supplied from the waveform measuring unit 21. If the cycle of the serial signal Rx is longer than 8 ms, the waveform analyzing unit 22 determines that a halt interval exists. Thus, the waveform analyzing unit 22 moves to step S15, where it sets an error flag. If the cycle of the serial signal Rx is shorter than or equal to 8 ms, the waveform analyzing unit 22 determines that no halt interval exists and moves to step S16.

At step S16 (stability determining step), the waveform analyzing unit 22 determines stability of the serial signal Rx by executing steps S12 and S14 repeatedly until passage of the prescribed time from the time of the start of reception of the serial signal Rx. That is, by executing steps S12 and S14 repeatedly until a predetermined time period of one second or more lapses from the time of the start of reception of the serial signal, the waveform analyzing unit 22 eliminates an erroneous signal, if any, that is input to the information determination unit 4 due to mixture of noise or the like on the serial signal Rx. If at step S17 it is determined that an error flag is set, the waveform analyzing unit 22 moves to step S19, where it sets a DALI dimming mode and outputs DALI command information Sd to the DALI dimming signal generation unit 5. If an error flag is not set, the waveform analyzing unit 22 moves to step S18, where the waveform analyzing unit 22 sets a PWM dimming mode and outputs PWM dimming information Sp to the PWM dimming signal generation unit 8. In this manner, it becomes possible to accommodate both of a PWM signal and a DALI signal by a simple configuration.

In the light source driving device 1 according to the embodiment of the invention, a PWM dimming instruction signal Sadp or a DALI dimming instruction signal Sadd can be received as a dimming instruction signal Sad and a serial signal Rx corresponding to the received dimming instruction signal Sad can be input to the common dimming controller 3. That is, the light source driving device 1 may not necessarily be equipped with dimming controllers for the respective dimming methods or a switching means for selecting between the dimming methods. As a result, the dimming circuit can be simplified and, accordingly the number of components can be reduced and the device can be miniaturized.

Although in the embodiment the frequency of a PWM dimming instruction signal Sadp is 1 kHz, it is just an example (i.e., it is not restricted to 1 kHz). The prescribed cycle (8 ms) of a serial signal Rx and the prescribed time (1 s) from a reception start time which are employed in the embodiment are just examples and limitation to these values is not intended. Furthermore, the waveforms shown in FIG. 2 are just examples and the waveforms need not always be of negative logic (low active).

Although the present invention has been described using the embodiment, it goes without saying that the technical scope of the present invention is not limited to the embodiment. It is apparent to those skilled in the art that various changes and modifications can be made to the embodiment. And it is apparent from the claims that modes with such changes and modifications are included in the technical scope of the present invention.

What is claimed is:

1. A light source driving device comprising:

a single interface circuit configured to receive a PWM dimming instruction signal or a DALI dimming instruction signal as a dimming instruction signal and generate a serial signal in accordance with the dimming instruction signal;

a dimming controller configured to determine whether the serial signal generated by the interface circuit is based on the PWM dimming instruction signal or the DALI dimming instruction signal and to generate a dimming signal according to a result of the determination; and a drive circuit configured to drive a light source according to the dimming signal generated by the dimming controller, wherein the dimming controller comprises:

an information determination unit configured to determine whether the received serial signal is based on the PWM dimming instruction signal or the DALI dimming instruction signal and to generate DALI command information or PWM dimming information according to a result of the determination;

a DALI dimming signal generation unit configured to receive the DALI command information and to generate the dimming signal based on the DALI command information; and a PWM dimming signal generation unit configured to receive the PWM dimming information and to generate the dimming signal based on the PWM dimming information.

2. The light source driving device according to claim 1, wherein the information determination unit comprises:

a waveform measuring unit configured to measure a cycle of the serial signal and to output measurement information indicating a result of the measurement; and a waveform analyzing unit configured to receive the measurement information and to determine whether the serial signal contains a DALI frame based on the measurement information.

3. The light source driving device according to claim 2, wherein the waveform analyzing unit is configured to:

output PWM dimming information to the PWM dimming signal generation unit when the cycle of the received serial signal is shorter than or equal to a preset value and the serial signal contains no DALI frame; and output DALI command information to the DALI frame control unit if the received serial signal contains a DALI frame.

4. A method for driving a light source according to a dimming instruction signal, the method comprising:

receiving a PWM dimming instruction signal or a DALI dimming instruction signal as the dimming instruction signal;

generating a serial signal in accordance with the dimming instruction signal;

determining whether the serial signal is based on the PWM dimming instruction signal or the DALI dimming instruction signal;

generating a dimming signal according to a result of the determination; and driving a light source according to the dimming signal, wherein the dimming signal generating step further comprises:

generating DALI command information or PWM dimming information according to a result of the determination;

generating the dimming signal based on the DALI command information when the DALI command information is generated; and generating the dimming signal based on the PWM dimming information when the PWM dimming information is generated.

5. The method according to claim 4, wherein the dimming signal generating step further comprises:

determining whether the serial signal contains a DALI frame; and determining whether a cycle of the serial signal is shorter than or equal to a preset value when determined that the serial signal contains no DALI frame.

6. The method according to claim 5, wherein the DALI frame determining step and the cycle determining step is repeated during a predetermined time period starting from a reception of the serial signal.

* * * * *